United States Patent [19]

Cairns

[11] 4,373,767

[45] Feb. 15, 1983

[54] UNDERWATER COAXIAL CONNECTOR

[76] Inventor: James L. Cairns, 2348 Kentucky Ave., Mims, Fla. 32754

[21] Appl. No.: 189,950

[22] Filed: Sep. 22, 1980

[51] Int. Cl.[3] ..... H01R 13/52

[52] U.S. Cl. ..... 339/94 C; 339/117 R; 339/177 R

[58] Field of Search ..... 339/89, 94, 96, 117, 339/177

[56] References Cited

U.S. PATENT DOCUMENTS

| | | | |
|---|---|---|---|
| 1,255,181 | 2/1918 | Klein | 339/94 A |
| 3,643,207 | 2/1972 | Cairns | 339/96 |
| 4,085,993 | 4/1978 | Cairns | 339/94 A |
| 4,167,300 | 9/1979 | Fischer et al. | 339/94 C |

*Primary Examiner*—Joseph H. McGlynn
*Attorney, Agent, or Firm*—Brown & Martin

[57] ABSTRACT

A plug and socket type electrical connector for connection underwater. The female part of the connector contains a socket element enclosed in a dielectric fluid filled chamber which is sealed by a penetrable seal element. The plug or male part of the connector has an extended contact probe of round cross-section which penetrates the seal element to enter the socket and complete the connection, the two connector parts having housings with a threaded connection for securing the connector. The penetrable seal is specifically designed to accommodate repeated insertion and withdrawal of a male probe of round cross-section without loss of dielectric fluid or water leakage. The seal design does not restrict the male probe size, making the connector particularly adaptable for use with a probe having multiple electrical contacts arranged coaxially. It is further adaptable for use with coaxial cable having a central conductor and a concentric shield, the connector maintaining the integrity of the shielded cable.

18 Claims, 11 Drawing Figures

UNDERWATER COAXIAL CONNECTOR

BACKGROUND OF THE INVENTION

Electrical connectors that can be connected and disconnected underwater are well-known in single and multiple pin types. The usual structure comprises a socket or female portion with electrical connections enclosed in a sealed chamber. The chamber is often filled with a dielectric fluid or semi-mobile compound (grease or gel) to minimize arcing and water contamination. The electrical connection takes place when a male contact probe penetrates the chamber and engages the female contact elements therein. The greatest problem is to keep water from entering the interior of the chamber and to keep the dielectric filler from leaking out, particularly during mating and unmating. Several schemes have been employed in the past to accomplish this.

Fluid filled connectors can be adequately sealed using blade type male pins of flat cross-section in combination with a resilient sealing element having normally closed, penetrable slits. A good example is disclosed in my U.S. Pat. No. 3,643,207, entitled Sealed Electrical Connector. Other fluid filled connectors are sealed by having cylindrical probes that involve mating seals and shuttle pistons driven by springs. Examples are shown in U.S. Pat. Nos. 4,188,084; 4,039,242 and 4,174,875. Connectors of this second type having pistons, springs and sliding seals are complex and expensive.

Connectors having chambers filled with semi-mobile dielectric compounds have used small diameter male probes of round cross-section in combination with perforated resilient seals held normally closed by compression to solve the sealing problem. A single round pin type is illustrated in my U.S. Pat. No. 3,522,576 entitled Underwater Electrical Connector. Another example involving multiple round pins penetrating resilient seals into a chamber filled with a semi-mobile dielectric compound is described in U.S. Pat. No. 3,972,581.

For reasons which will now be discussed, male contact probes having round cross-section that can be of variable diameter along their length, are superior to blade type probes of flat cross-section in many applications. Round probes are stronger than flat probes of equal cross-section. Round probes create radially symmetrical electric fields, and so do not have sharp field maxima with the associated problems of insulation difficulties and electrical leakage. Round probes are easier and cheaper to manufacture. Most importantly, round probes lend themselves to applications involving multiple electrical contacts arranged coaxially in a single male probe.

Connectors with fluid filled chambers are superior in many applications to connectors with chambers filled with semi-mobile dielectric compounds. Fluid, by virtue of its mobility, can respond rapidly to changes in ambient pressure. Because of this sensitivity, fluid filled connectors can be used in applications calling for connectors that are unaffected by explosions in the nearby environment. Fluid can also respond rapidly to volume displacement, as occurs with the rapid withdrawal of the male probe from the chamber. A semi-mobile compound will often cavitate in similar circumstances, thereby pulling in the more mobile air or water from the exterior to fill the void created by the withdrawn probe instead of actuating a volume compensating mechanism usually provided within the chamber itself. For the same reason of restricted mobility, the rapid insertion of a male probe into the chamber will sometimes result in the compound being extruded past the probe and out of the chamber instead of actuating the volume compensator. More important than this, however, is the fact that semi-mobile compound can support contaminants in paths or fissures within the compound. For example, a male probe repeatedly entering and leaving a chamber filled with semi-mobile compound will always travel the same path from exterior environment to female contact element through the same bit of compound, as the compound does not move readily within the chamber. Thus contaminants entering with the probe each time it penetrates continue to build up in the compound in a direct path between the female electrical contact and the outside environment, resulting in degradation of the electrical characteristics of connector. In contrast, contaminants entering a fluid filled connector, due to the mobility of the fluid, disperse in suspension throughout the fluid in the chamber and so do not concentrate in a direct path between the interior contacts and the outside environment. Furthermore, since the fluid chosen as a filler is usually an oil, any water entering the chamber forms a small bead within the oil rather than a fissure, and so does not tend to bridge the gap to the exterior environment or to other contacts within the chamber.

As may be understood for many applications, the most advantageous connector of this general type would be one utilizing male probes of round cross-section penetrating a perforated resilient seal into a chamber filled with dielectric fluid. None of the above mentioned patents solves the problem of providing a connector in which a simple male probe of round cross-section, and which may have multiple coaxial contacts, can be sealably inserted and withdrawn from a dielectric fluid filled chamber, repeatedly and without tools or accessory equipment.

SUMMARY OF THE INVENTION

The embodiment of the connector described herein has two electrical contacts arranged coaxially. It is particularly adapted to accommodate repeated connection and disconnection of a coaxial cable underwater, or in any other hazardous atmosphere, without contamination or electrical short circuiting of the contacts. Connection is made by a simple plug-in action and the coupling is secured by a screw threaded connection which is made by manual rotation of the two parts of the connector, no tools or accessory equipment being necessary. The impedance of the coaxial cable is closely matched through the connection.

The female part of the connector contains a coaxial socket enclosed in a dielectric filled chamber, which is pressure compensated to ambient pressure by venting, the chamber being closed by a resilient seal element. This seal element comprises an elongated cylindrical sleeve of elastomeric material which is enclosed in a resilient constrictor member that flattens out and tightly closes the cylindrical sleeve. The sleeve is of sufficient length to allow penetration of a large diameter coaxial pin from the male part of the connector, without losing the integrity of the seal.

The male and female parts of the connector have interfitting housings with a manually operable screw threaded coupling. All sealing occurs within the interior of the female connector, the major portion of the coupled connector being vented to ambient conditions. The connector has no moving parts, which greatly simplifies the structural design.

Thus there is provided as a preferred embodiment an underwater connector having one or more male probes of round cross-section penetrating a perforated resilient seal into a chamber filled with dielectric fluid, and that can be used to make coaxial connections. Further, the embodiments can function to provide sealed sections in underwater coaxial lines by being positioned at spaced intervals in the underwater coaxial lines. If a water penetration occurs in the coaxial line, then the penetration is localized because water cannot flow through the coaxial line and through the connector.

The primary object of this invention, therefore, is to provide a new and improved underwater connector.

Another object of this invention is to provide a new and improved underwater coaxial connector.

Another object of this invention is to provide a new and improved underwater coaxial connector which can be used repeatedly without deterioration of the seal or electrical connection.

Another object of this invention is to provide a new and improved underwater connector having a male probe of round cross-section penetrating a perforated resilient seal into a chamber filed with dielectric fluid.

A further object of this invention is to provide a new and improved underwater coaxial connector which has no moving parts and is very simple to construct and use.

Other objects and advantages will be apparent in the following detailed description, taken in conjunction with the accompanying drawings, in which.

DESCRIPTION OF THE PREFERRED EMBODIMENT

Figures 1, 2, 3:
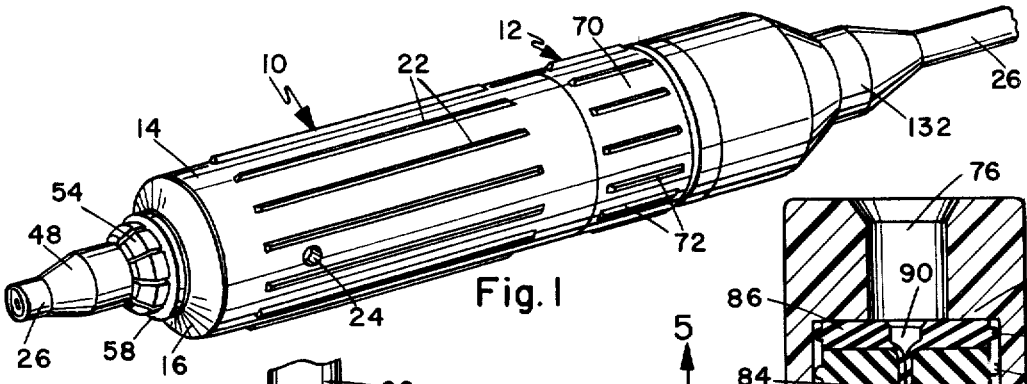
FIG. 1 is a perspective view of the assembled connector.
FIG. 2 is an enlarged longitudinal sectional view of the male connector unit.
FIG. 3 is an enlarged longitudinal sectional view of the female connector unit.

The connector comprises a male unit 10 and a female unit 12, illustrated in detail in FIGS. 2 and 3, respectively. The two units interconnect to form an integral cylindrical connector, as in FIGS. 1 and 4.

Male unit 10 includes a hollow cylindrical body 14, one end of which has an end wall 16 with a central opening 18, the other end being open and having internal screw threads 20. The exterior of body 14 is provided with longitudinal ribs 22 to facilitate manual gripping for rotation. A vent opening 24 in the side wall of body 14 vents the interior to exterior pressure.

Coaxial cable 26 comprises a central conductor 28 surrounded by an insulating layer 30. An outer conductor 32, which may be of the woven type as shown or of foil type, surrounds the insulating layer 30 and the whole is enclosed in an outer insulating jacket 34, the structure being well-known. The central conductor is secured in a socket 36 on the end of a central contact pin 38, which is circular in cross-section and which extends axially in body 14 to the threaded end. Contact pin 38 and socket 36 are surrounded by an insulating layer 40, preferably of the same material and size as insulating layer 30 for impedance matching. A conductive outer contact layer 42 surrounds the insulating layer and extends almost the full length of pin 38 to form a dual conductor contact probe. At the tip of contact pin 38 near the open end of the body, the pin is supported in a conical penetrator tip 44 of hard non-conductive material such as filled resin or plastic. Conical tip 44 is sealed bonded by contact pin 38 and outer contact layer 42, thereby blocking the passage of water or other fluid through the male probe and into the interior of the cable or vice versa. Contact pin 38 projects beyond the tip 44 which allows the male contact probe to be pushed easily through the seal.

Outer conductor 32 of the coaxial cable is pushed over the outside of outer contact layer 42 to an enlarged annular rib 46 formed on the contact layer, and is secured by soldering, crimping, or other suitable means. The connection is encased in an insulated boot 48 formed by potting the assembly in a suitable mold with neoprene or similar material. The boot encloses rib 46 to lock the connection in place and extends outwardly along the cable 26 to provide support. Boot 48 seats in a retaining collar 50 which fits through opening 18 and has a shoulder 52 which bears against the inside of end wall 16. The protruding end of retaining collar 50 is slit longitudinally to form prongs 54, which seat in an annular channel 56 in boot 48 to secure the collar on the boot. A snap ring 58 is snapped into an annular groove 60 in the outside of prongs 54 and bears on the outer end of body 14 to hold the assembly together, while allowing the body to rotate on the collar 50. The resiliency of the boot material and the prongs allow the members to be forced into place to obtain a secure coupling. Boot 48 is slightly recessed in collar 50 and the inner end of the collar has radial slots 62 to allow passage of water when the connector is assembled. The contact layer 42 is encased in and bonded to an insulating sleeve 64, which may be formed integrally with boot 48, or applied separately and sealed to the boot. Sleeve 64 extends almost to the end of the contact layer 42, leaving the end portion exposed adjacent the penetration tip 44.

The female unit 12 comprises a hollow cylindrical outer body 66 which fits closely into body 10 and has a screw threaded portion 68 to engage with threads 20. Water is free to circulate in the space between body 66 and body 10. The outer end of body 66 has an enlarged barrel portion 70, equal in diameter to body 10, and having similar external ribs 72 for manual gripping. At the inner end of body 66 is an end wall 74 having a central axial opening 76.

Seated against the inner face of end wall 74 is a seal 78, which is illustrated in detail in FIGS. 5-8. The seal 78 includes a cylindrical constrictor 80 having a substantially closed slit 82 elongated diametrically and extending axially through the constrictor, which is a unitary element of gum rubber or similar elastomeric material. The other component of the seal is a thin walled cylindrical sleeve 84, having at one end a flange 86 equal in diameter to constrictor 80, and at the other end a retaining flange 88 of lesser diameter. In the center of flange 86 is an entry socket 90 coaxial with sleeve 84 to guide the male probe or connector into the seal. The sleeve element is made of an elastomer such as fluorosilicone rubber, or similar material having surface characteristics to facilitate passage of the male connector. The sleeve element fits through the slit 82 with the flanges seated firmly against opposite ends of the constrictor 80. The constrictor holds the sleeve 84 tightly closed in a flat condition, as in FIG. 5. Constrictor 80 has a pair of external annular ribs 92 and flange 86 has an annular rib 94, which hold the seal inside body 66 with a small annular clearance, as in FIGS. 3 and 5.

Fitted inside body 66 is a smaller cylindrical inner body 96, having an enlarged base 98 and an enlarged head 100. The base 98 and head 100 fit closely in the body 66 and are sealed to the inner wall by O-rings 102. Head 100 has a socket 104 which fits closely over retaining flange 88, and the inner body 96 is held securely against seal 78 by a snap ring 106 fitted internally in barrel portion 70 to engage the end of base 98.

Secured in the inner body 96 is a tubular outer conductor 108 having a cup 110 which seats in a socket 112 in the outer end of barrel portion 70. The inner end of outer conductor 108 is diametrically slit to provide a resilient socket 114. Inside the outer conductor 108 is a central conductor 116, supported coaxially therein by insulating sleeves 118 at opposite ends. Between the insulating sleeves is a seal band 120 of resin or the like, which can be injected through the side of the outer conductor to provide a hard seal against water seepage. This would prevent seepage of water through the woven outer conductor 32 to the interior of body 96, in the event that the outer jacket 34 of the coaxial cable is damaged. It also prevents seepage into the woven outer conductor 32 from the other direction, that is if the connector fails or is broken, water cannot enter through the connector and go up the cable. Central conductor 116 has a pin socket 122 in the inner end to receive contact pin 38, and a pin socket 124 in the outer end in which is inserted a pin connector 126.

The central conductor 28 of coaxial cable 26 is secured in the pin connector 126 and the outer conductor 32 is clamped into contact with cup 110 by a ferrule 128 fitted around the cable. The ferrule is secured by a screw plug 130 threaded into the outer end of socket 112. The connection is secured and protected by a boot 132 molded around the end of barrel portion 70 and the coaxial cable 26. Boot 132 locks into an annular channel 134 in barrel portion 70 and penetrates the interior of the barrel portion to surround the screw plug 130 and snap ring 106, bonding the assembly securely.

Surrounding the inner body 96 is a cylindrical bladder 136, one end of which is sealably retained in a groove 138 in base 98, the other end being similarly retained in a groove 140 in head 100. A transfer port 142 in the wall of the inner body 96 connects the interior of that body with the interior of bladder 136, forming a double chamber which is filled with a dielectric fluid 144. In the normal position the bladder is partially collapsed, as in FIG. 3, leaving an annular expansion chamber 146 between the outside of the bladder and the inside of outer body 66. The expansion chamber 144 is vented to the exterior through a port 148 in the outer body 66.

To assemble the connector the outer body 66 of the female unit 12 is inserted into the open end of male unit body 14. This centers the two units closely enough so that the tip of central conductor 38 is guided into entry socket 90 of seal 78. The units are then pushed axially together, forcing the male contact probe into the sleeve 84 of the seal which expands and maintains a seal against the insulating sleeve 64. The head conical penetrator tip 44 aids in entry and the slippery surface characteristic of the sleeve material allows the tip to slide through. With use, the sleeve 84 is lubricated by a film of dielectric fluid that forms on it as the male probe is pre-lubricated. Pressure is continued until the screw threads 20 and 68 are engaged, then body 14 is rotated to screw the two units together. This drives the central contact pin 38 into socket 122 and pushes the exposed end of outer contact layer 42 into the resilient socket 114 to complete the connection.

As the connector units are brought together under water, trapped water is driven out through vent port 24, the slots 62 allowing water to escape from opening 76. Entry of the male contact probe into the inner body 96 displaces dielectric fluid out through transfer port 142, the bladder 136 expanding into chamber 146 to accommodate the displacement, as in FIG. 4. The exterior of bladder 136 is exposed to external ambient pressure through port 148, since the interior of the body 14 remains water filled. This prevents the possibility of leakage due to any pressure differential between the interior and exterior of the assembly.

Figure 4:
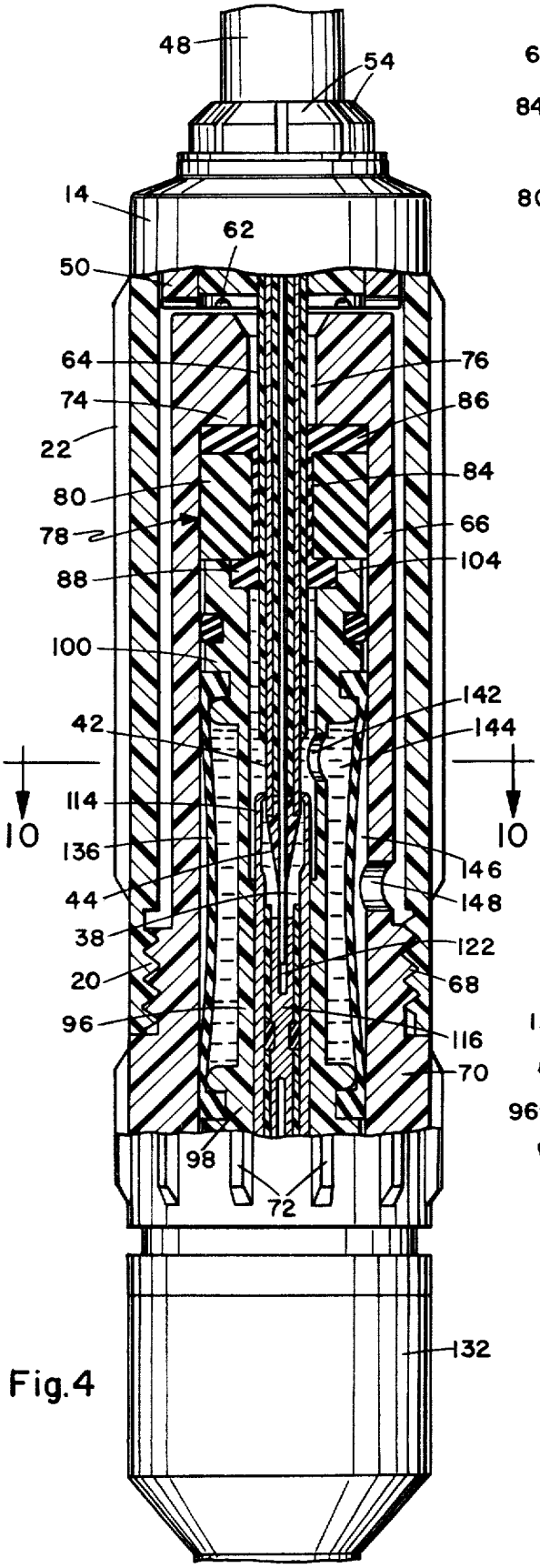
FIG. 4 is a side elevation view of the assembled connector, with portions in section.
Figure 5:
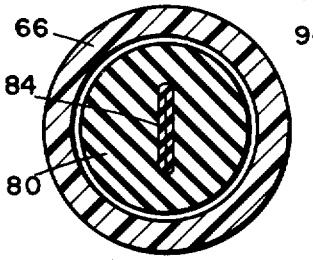
FIG. 5 is a sectional view taken on line 5—5 of FIG. 3.
Figure 6:
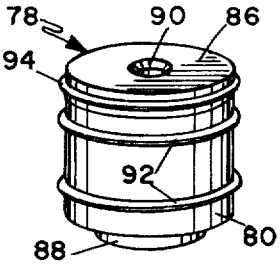
FIG. 6 is a perspective view of the seal element.
Figure 7:
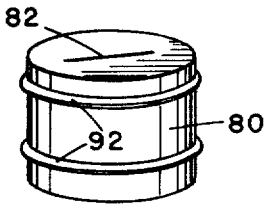
FIG. 7 is a perspective view of the constrictor portion of the seal element.
Figure 8:
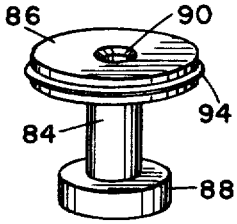
FIG. 8 is a perspective view of the sleeve portion of the seal element.
Figure 9:
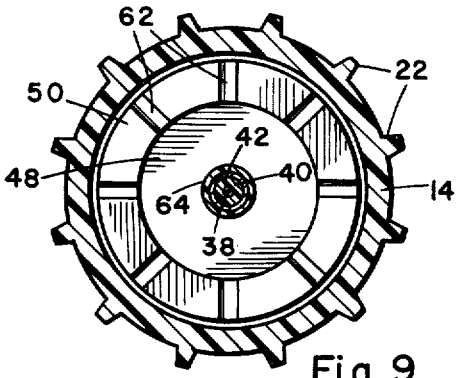
FIG. 9 is a sectional view taken on line 9—9 of FIG. 2.
Figure 10:
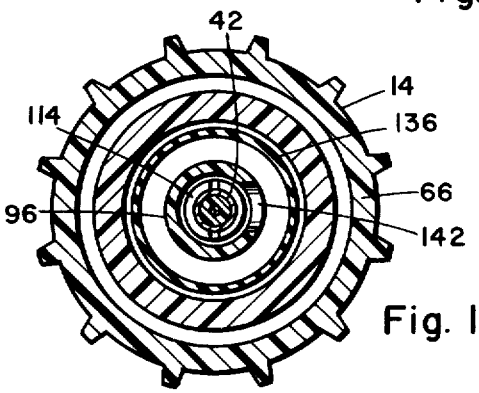
FIG. 10 is a sectional view taken on line 10—10 of FIG. 4.
Figure 11:
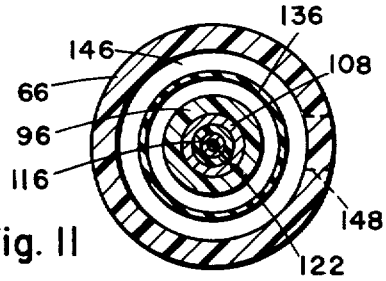
FIG. 11 is a sectional view taken on line 11—11 of FIG. 3.

It should also be noted in FIG. 4 that the ribs on the outside of the seal components have been flattened out due to the radial expansion caused by the insertion of the male contact probe. The seal thus jams firmly into the body 66 and adds to the sealing effect. It is not necessary to tighten the threaded connection excessively, the manual grip afforded by ribs 22 and 72 being ample. This and the simplicity of insertion alignment and connection make the connector readily adaptable to handling by mechanical manipulators, as on a remote controlled submersible vehicle.

To break the connection of the body 14 is simply unscrewed and the units pulled apart. The constructed sleeve 84 closes behind the conical tip 44 as it is withdrawn and maintains the seal. Using the type of materials described the seal is capable of handling many connections and disconnections under considerable external pressure.

The impedance of the coaxial cable is closely matched through the connector since, except for a slight increase in the inner diameter of the circular in cross-section central conductor 116 at socket 114, the size and materials of the connecting elements are substantially the same as those of the cable.

The various body components are preferably made from plastic material for insulation and corrosion resistance. One particularly suitable material is a glass reinforced polybutylene terephthalate flame retardant plastic known as Fiberite, but other such materials could be used. Bladder 136 can be of fluorosilicone elastomer, or similar tough and chemical resistant material.

While the connector is illustrated for use with a single coaxial cable, it could be adapted to multiple cables with suitable arranged seals. Also the connector could be used for a current carrying cable, since the connections are made in the dielectric fluid which has excellent insulating properties and resists arcing.

Having described my invention, I now claim:

1. An underwater coaxial connector, comprising:
a male unit having a hollow cylindrical body with an open end;
a conductive contact probe mounted axially in said body with an entry tip adjacent the open end;
a female unit having a body portion to fit into said hollow body;
a seal mounted in said body portion and having an entry opening to receive the contact probe, said seal including an axially extending, elastomeric cylindrical sealing sleeve which is normally a close sliding fit for the contact probe, and a compressible constrictor surrounding the sealing sleeve and holding the sleeve in a flattened, sealed condition;
a conductive socket member mounted in said body coaxial with the sealing sleeve for engagement by said contact probe;
and securing means for securing the male and female units together.

2. An underwater coaxial connector according to claim 1, wherein said constrictor is an elastomeric body having a normally closed flat slit extending axially therethrough, said sealing sleeve being axially contained within said slit.

3. An underwater coaxial connector according to claim 2, wherein said sleeve has retaining flanges on opposite ends thereof bearing against the ends of said constrictor, one of said flanges having a contact probe receiving socket.

4. An underwater coaxial connector according to claim 3, wherein said body portion has a hollow cylindrical interior in which said seal is contained, said constrictor being cylindrical and having compressible annular ribs sealing the constrictor against the interior surface of the body portion.

5. An underwater coaxial connector according to claim 1, wherein said securing means includes internal screw threads in said open end;
said female unit body portion having external screw threads for engagement with the internal screw threads when the two units are joined and said contact probe is engaged in said conductive socket member.

6. An underwater coaxial connector according to claim 5, wherein said male unit includes a collar in which said contact probe is mounted, with connecting means in the collar for connection of the contact probe to a coaxial cable;
said hollow body being axially rotatably mounted on said collar.

7. An underwater coaxial connector according to claim 6, wherein said body portion has an enlarged barrel portion substantially equal in diameter to said hollow body, the barrel portion and hollow body each having external manual gripping ribs thereon.

8. An underwater coaxial connector according to claim 1, wherein said body portion is hollow and has an end wall with a contact probe receiving opening therein, said seal being secured in the body portion against said end wall.

9. An underwater coaxial connector according to claim 8, and including an inner body axially mounted in and spaced from said body portion, said inner body having an enlarged base and an enlarged head at opposite ends, sealed to the body portion, said head bearing axially against and holding said seal;
said conductive socket member being fixed in said inner body and having means therein for connection to a coaxial cable.

10. An underwater coaxial connector according to claim 9, wherein said contact probe comprises a central contact pin and an outer contact concentric therewith, with insulation therebetween;
said conductive socket member comprising an outer contact element with a socket for engagement with the probe outer contact, and a central conductor insulated from the outer contact element, with a socket for receiving said probe contact pin.

11. An underwater coaxial connector according to claim 10, wherein said contact probe has a hard conical entry tip projecting beyond said outer contact, said central contact pin projecting beyond the entry tip.

12. An underwater coaxial connector according to claim 10, wherein the electrical contact and insulation elements in said male and female units are closely impedance matched to the coaxial cable to be connected thereto.

13. An underwater coaxial connector according to claim 9, and including a flexible bladder secured to said head and base and surrounding said inner body to form an annular chamber, a transfer port in said inner body connecting the interior of the inner body with the chamber, said chamber and inner body being substantially filled with dielectric fluid.

14. An underwater coaxial connector according to claim 13, and including a port in said body portion venting the exterior of the body portion to the exterior of said bladder.

15. An underwater coaxial connector according to claim 14, and including a venting port in said hollow body connecting the interior thereof to the exterior.

16. An underwater coaxial connector, comprising:
a male unit having a body with a conductive contact probe of circular cross-section therein;
a female unit having a body with a chamber therein containing a dielectric fluid;
said chamber having an elastomeric seal for penetration by said contact probe;
said seal including a sleeve through which said contact probe will slidably fit, and a compressible restrictor surrounding said sleeve and holding the sleeve in closed condition;
and a conductive socket in said chamber to receive the contact probe.

17. An underwater coaxial connector according to claim 16, wherein said constrictor has a normally closed, diametrically extended slit extending therethrough, said sleeve being held in a flat closed condition within the slit.

18. An underwater coaxial connector according to claim 16, and including a flexible bladder surrounding and sealed to said chamber, said bladder containing dielectric fluid and communicating with the chamber;
said body elements being vented to expose said bladder to external ambient conditions.

* * * * *